United States Patent [19]

Biller

[11] 4,135,174

[45] Jan. 16, 1979

[54] CURRENT LIMITING FUSE CONSTRUCTION

[75] Inventor: Bruce A. Biller, Chicago, Ill.

[73] Assignee: S&C Electric Company, Chicago, Ill.

[21] Appl. No.: 817,985

[22] Filed: Jul. 22, 1977

Related U.S. Application Data

[63] Continuation of Ser. No. 708,146, Jul. 23, 1976, abandoned.

[51] Int. Cl.[2] ..... H01H 85/20

[52] U.S. Cl. ..... 337/186; 337/248

[58] Field of Search ..... 337/158, 159, 186, 201, 337/202, 205, 248

[56] References Cited

U.S. PATENT DOCUMENTS

| | | | |
|---|---|---|---|
| 2,247,084 | 6/1941 | Goff | 337/248 |
| 2,874,249 | 2/1959 | Jacobs, Jr. et al. | 337/248 |
| 3,483,501 | 12/1969 | Kozacka | 337/248 X |
| 3,648,211 | 3/1972 | McKeithan | 337/246 X |
| 3,699,491 | 10/1972 | Vrabel et al. | 337/246 |

*Primary Examiner*—George Harris

*Attorney, Agent, or Firm*—Kirkland & Ellis

[57] ABSTRACT

An integrally molded current limiting fuse body having surface elongating skirts integrally molded thereto to increase the surface leakage distance may be used in conjunction with various types of end closures for one or both of the ends of the fuse body. One type of end closure utilizes a metallic end cap to which the mounting studs of the fuse are attached which has an annular flange formed to the edge thereof which is folded over the end of the fuse body to lock the fuse cap over the open end of the fuse body. Another type of end enclosure comprises a molded plastic end cap which can be locked to the end of the fuse housing by a suitable adhesive. The mounting stud may be either attached to the plastic end cap by a threaded nut or may be integrally molded into the end cap. Another type of end closure comprises a metallic plate that overlies the open end of the fuse body and which is held over the open end of the fuse body by a threaded annular flange arrangement which engages threads on the fuse body. One end of the fuse body may have an integrally molded end wall through which a mounting stud may be mounted either by a threaded nut or by molding.

25 Claims, 4 Drawing Figures

CURRENT LIMITING FUSE CONSTRUCTION

This is a continuation, of application Ser. No. 708,146, filed July 23, 1976 now abandoned.

BACKGROUND OF THE INVENTION

1. Field of the Invention

The present invention relates to high voltage current limiting fuses, and more specifically, the present invention relates to unique construction of fuse bodies and enclosures therefor.

2. Description of the Prior Art

High voltage current limiting fuses are well known in the art. For example, U.S. Pat. Nos. 3,648,211 — McKeithan; 3,345,483 — Leonard et al.; 3,309,477 — Bronikowski; and 2,917,605 — Fahnoe all disclose various types of high voltage current limiting fuse constructions. Further, the assignee of the present application is also the assignee of other co-pending patent applications which relate to various aspects of high voltage current limiting fuse construction, namely, Ser. Nos. 633,373, filed Nov. 19, 1975; 633,488, filed Nov. 19, 1975; 633,487, filed Nov. 19, 1975; and 456,866, filed Apr. 1, 1974 now issued as U.S. Pat. No. 3,893,056.

Construction of high voltage current limiting fuses is difficult and often expensive because the forces generated during fuse operation require a sturdy well-constructed fuse body that will withstand these forces. Further, since such fuses are often mounted outdoors and are subject to weather, pollution, and contamination, special care and attention must be taken to assure that the high voltage current limiting fuses will neither leak moisture into the exterior thereof or be subject to external flash-over during or after fuse operation as a result of surface contamination or weather conditions. Accordingly, it would be a desirable advance in the art to provide high voltage current limiting fuse construction which permits relatively simple, inexpensive manufacturing techniques, while preserving the requisite strength and surface leakage characteristics necessary for proper fuse operation.

BRIEF DESCRIPTION OF THE INVENTION

The present invention constitutes improvements in current limiting fuses. Such current limiting fuses include a current responsive fusible element consisting of one or more conductive filaments electrically connected in parallel, a support member for supporting the fusible element, first and second mounting studs respectively electrically connected to opposite ends of the fusible element.

The improvements comprise an integrally molded hollow fuse body surrounding the fusible element and support member having exterior surface elongating means integrally molded thereto. An end sealing means is provided for closing at least one open end of the fuse body. One embodiment of the end sealing means comprises a molded end cap having the first mounting stud mounted therethrough. The molded end cap comprises an end wall overlying the at least one open end of the fuse body and an annular flange joined to the edge of the end wall. The flange is dimensioned to engage with the end of the fuse body and the flange is attached to the fuse body by an appropriate adhesive.

Another type of end sealing means comprises a metal end plate positioned over the at least one open end of the fuse body and the first mounting stud is mounted thereon. A threaded flange member is threadably adapted to engage threads on the end of the fuse body so that an annular extension on the flange member engages the end plate and securely holds the end plate over the at least one open end of the fuse body.

Yet another type of end sealing means for use in conjunction with the present invention comprises a metal end cap having an end wall dimensioned to overlie the at least one open end of the fuse body. The second mounting stud is mounted on the end wall, and an annular flange is integrally formed to the edge of the end wall and is folded over the exterior edge of the fuse body to lock the metal end cap over the at least one open end of the fuse. Such end sealing means may be used on both ends of the fuse body, or the fuse body may be formed so that it has an integrally molded end wall at one end thereof through which the second mounting stud is mounted. In this latter arrangement, the second mounting stud may be either molded into and through the end wall or placed through an opening through the end wall and attached by threaded nut.

The fuse body and molded end cap may be fabrciated from a suitable epoxy resin or polyester resin, and the resin may be modified by various fillers and fiber reinforcing materials.

Accordingly, it is a principal object of the present invention to provide improved construction of high voltage current limiting fuses which permit easy economical fabrication thereof.

Yet another object of the present invention is to provide a high voltage current limiting fuse having an integrally molded fuse body having surface elongating means in the form of skirts integrally molded thereto.

Yet another object of the present invention is to provide an improved high voltage current limiting fuse having improved end closures which are economical to fabricate and easy to assemble.

These and other objects, advantages, and features of the present invention shall hereinafter appear, and for the purposes of illustration, but not for limitation, exemplary embodiments of the present invention are illustrated in the accompanying drawings.

DETAILED DESCRIPTION OF THE PREFERRED EMBODIMENTS

Figure 1:
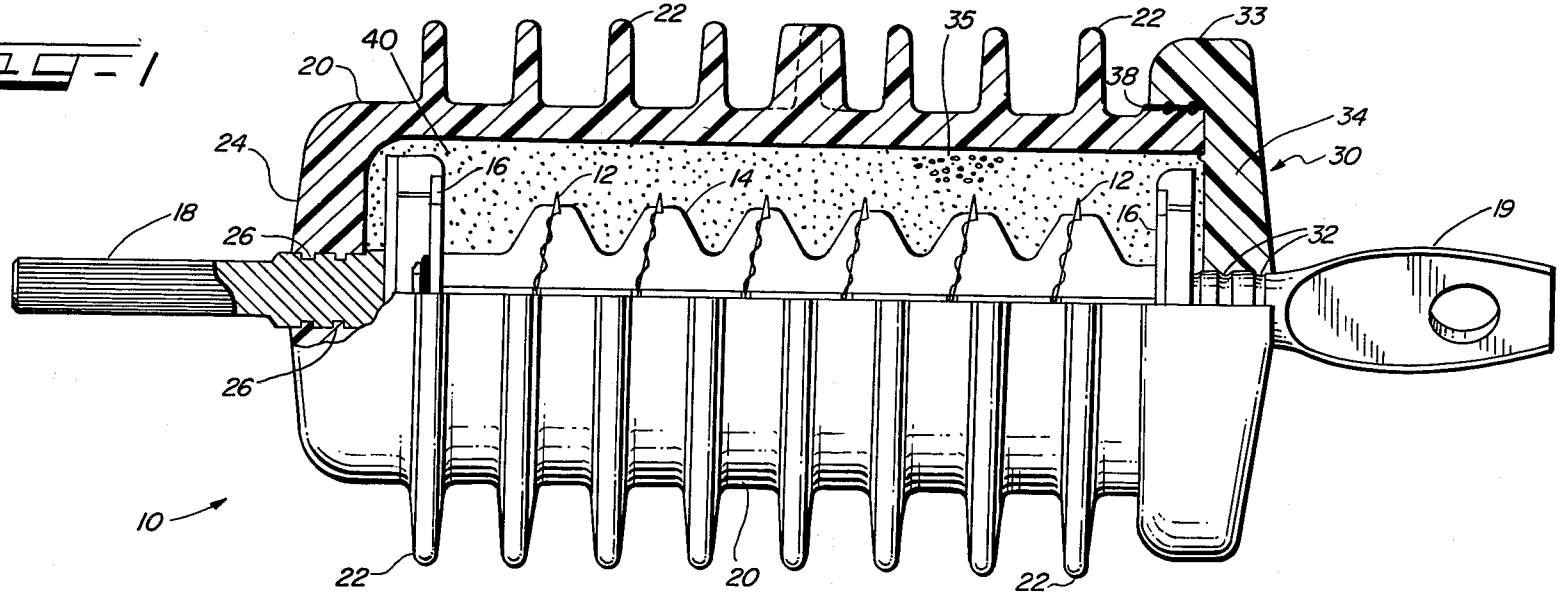
FIG. 1 is a side, partially cross-sectional view of one embodiment of the present invention.

With reference to FIG. 1, high voltage current limiting fuse 10 comprises a fusible element 12 that is helically wound around a support member 14. Mounted on each end of support member 14 are metallic terminators 16 which are electrically connected to the ends of fusible element 12. Terminators 16 are electrically connected to mounting studs 18 and 19 so that an electrical circuit is completed through the fuse. Support member 14 and terminators 16 may be fabricated in any conventional manner. However, the support member and terminators as illustrated herein for each of the FIGS. 1–4 embodiments are substantially the same as that disclosed in co-pending patent application Ser. Nos. 633,486, filed Nov. 19, 1975 and 633,293, filed Nov. 19, 1975, which are assigned to the same assignee as the present invention.

Mounted around fusible element 12 and support member 14 is an integrally molded fuse body 20. Annular skirts 22 are integrally molded to fuse body 20, and skirts 22 extend completely around fuse body 20. Fuse body 20 may be formed from any moldable electrically insulating material which is water resistant, impervious to moisture, and physically strong. Suitable materials for the fabrication of fuse body 20 are either a suitable filled or fiber reinforced epoxy resin or polyester resin.

As illustrated in FIG. 1, one end of fuse body 20 has an integrally molded end wall 24 through which mounting stud 18 has been molded. Stud 18 has recesses 26 formed in the end thereof extending through wall 24 to assure that stud 18 is securely molded into wall 24. The opposite end of fuse body 20 is covered by a molded plastic end cap 30 into and through which mounting stud 19 is molded. Stud 19 similarly has recesses 32 which facilitate and assure that stud 19 is securely bonded to end cap 30. End cap 30 may be fabricated from the same material as fuse body 20.

End cap 30 comprises a wall portion 34 which overlies the end of fuse body 20, and an integrally molded flange 33 which is dimensioned to slidably mate over the end of fuse body 20. A suitable adhesive 38 may be used to bond end cap 30 over the end of fuse body 20 to provide both a mechanically strong arrangement as well as one impervious to moisture. The hollow interior 40 of fuse body 20 may be filled with a suitable electrically non-conducting material 35 such as quartz sand.

Figure 2:
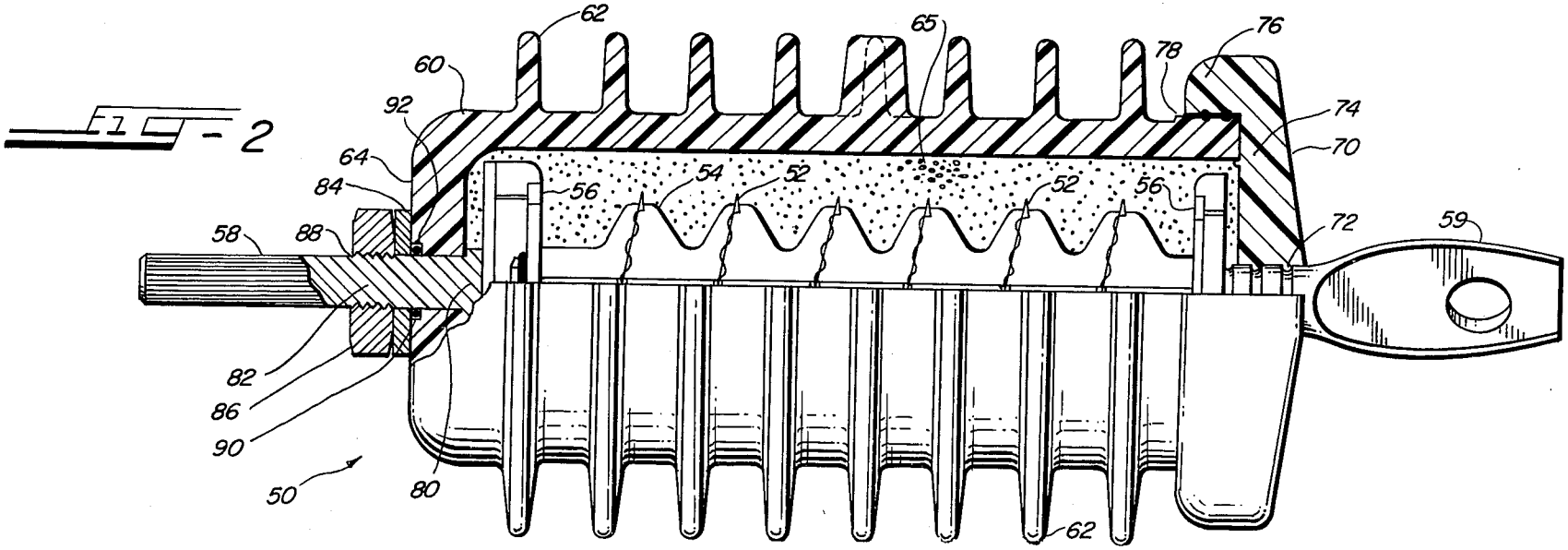
FIG. 2 is a side, partially cross-sectional view of another embodiment of the present invention.

With reference to FIG. 2, another embodiment of the present invention is illustrated which is very similar to the FIG. 1 embodiment. Current limiting fuse 50 comprises a fusible element 52, a support member 54, terminators 56, and mounting studs 58 and 59 which are substantially the same as those illustrated in FIG. 1.

An integrally molded fuse body 60 having integrally molded annular skirts 62 molded thereon and an integrally molded end wall 64 is also formed substantially the same as in the FIG. 1 embodiment. Similarly, in end cap 70 comprising a wall portion 74 and an integral flange 76 is attached to the fuse body by adhesive 78 in the same manner described with respect to FIG. 1. Mounting stud 59 is integrally molded through wall 74 and recesses 72 assure that mounting stud 59 is firmly molded to end cap 70 as previously described. Fuse body 20 may be filled with electrically non-conducting material 65.

The principal difference between the embodiment illustrated in FIG. 2 and that illustrated in FIG. 1 comprises the mounting of stud 58. Stud 58 has an enlarged head 80 and a smaller body portion 82. The body portion 82 extends through an opening through wall 64 but head 80 prevents stud 58 from passing through the opening so that it is retained. A washer 84 is positioned around body portion 82, and a threaded nut 86 is threaded onto threads 88 on stud 58 to lock stud 58 through the opening in end wall 64. An O-ring seal 90 is positioned in a recess 92 to prevent moisture from entering the interior of the fuse housing 60.

Figure 3:
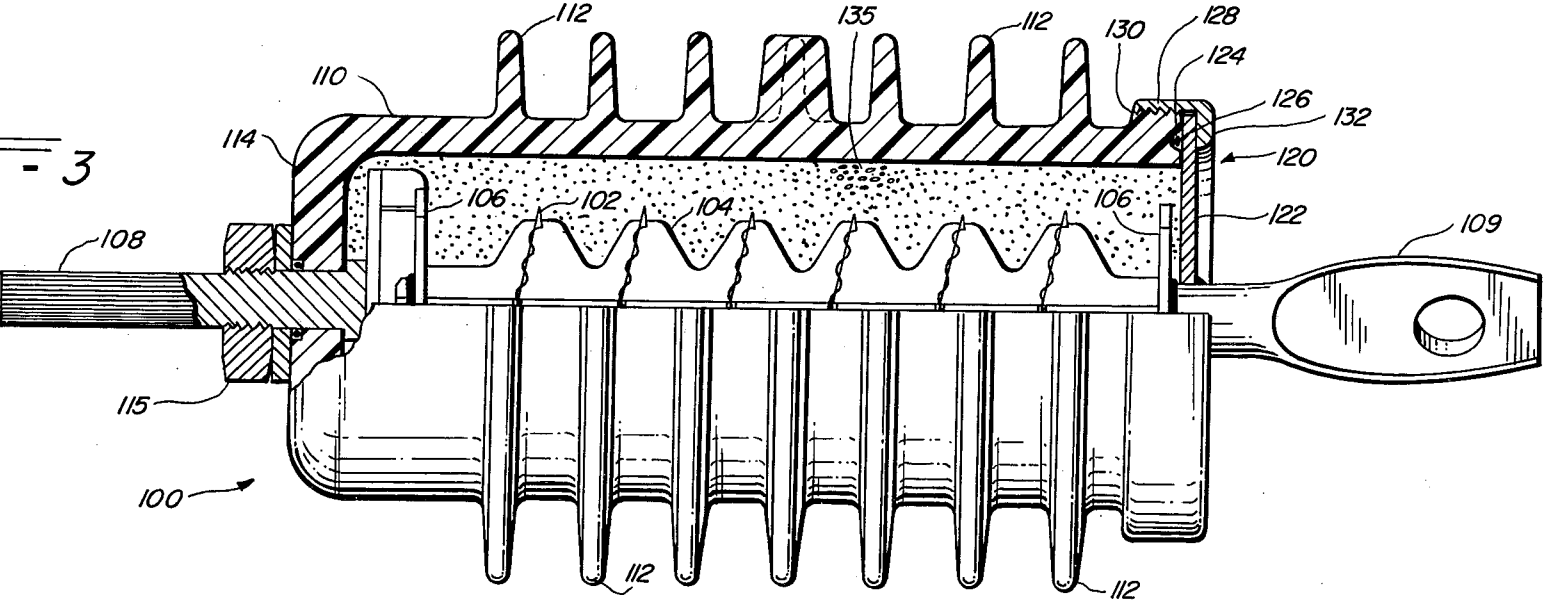
FIG. 3 is a side, partially cross-sectional view of yet another embodiment of the present invention.

With reference to FIG. 3, yet another embodiment of the present invention is illustrated. Current limiting fuse 100 is substantially similar to the embodiments illustrated in FIGS. 1 and 2 and comprises a fusible element 102 helically wound around a support member 104 and attached to each end to terminators 106 which in turn are connected to mounting studs 108 and 109.

An integrally molded fuse body 110 having annular skirts 112 integrally formed on the exterior thereof is positioned around the fusible element 102 and support member 104. Fuse body 110 has an end wall 114 integrally molded thereon and mounting stud 108 is attached in the same manner as that illustrated in FIG. 2 by a threaded nut 115.

On the opposite end of fuse body 110 is an end sealing assembly 120 which comprises an end plate 122 overlying the open end of fuse body 110. Mounting stud 109 is mounted on end plate 122 and may be attached by a suitable means such as welding. Terminator 106 is connected to mounting stud 109 so that an electrical circuit is completed through the fuse.

Positioned in a recess 124 is an O-ring seal 126 which provides a seal to prevent the entry of moisture into the interior of fuse body 110. A threaded flange member 128 is threaded onto threads 130 on the end of fuse body 110 so that an annular extension 132 secures end plate 122 over the end of fuse body 110. Fuse body 110 may be filled with an electrically non-conducting material 135.

Figure 4:
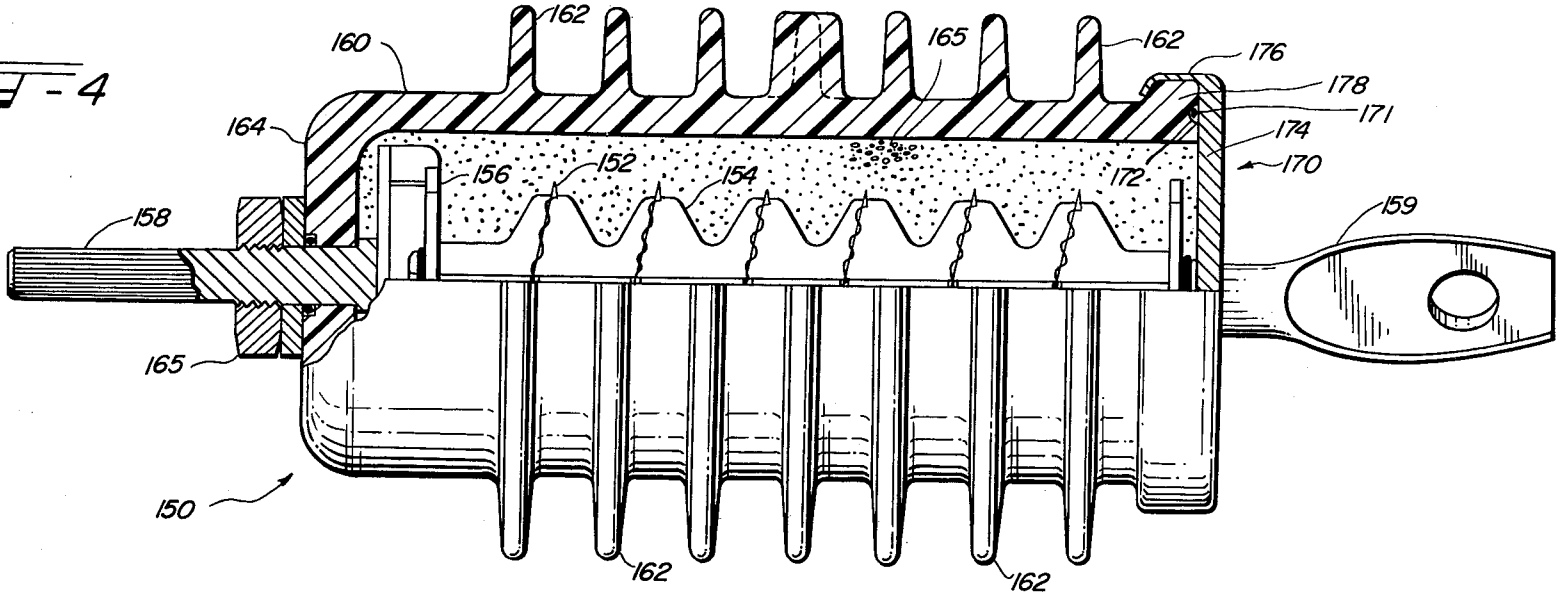
FIG. 4 is a side, partially cross-sectional view of yet another embodiment of the present invention.

With reference to FIG. 4, yet another embodiment of the present invention is illustrated. Specifically, current limiting fuse 150 comprises a fusible element 152 helically wound around a support member 154 as previously described with respect to FIGS. 1, 2, and 3. Mounted to each end of support member 154 are terminators 156 which are electrically connected to the ends of fusible element 152. Similarly, mounting studs 158 and 159 are electrically connected to terminators 156 so that an electrical circuit is completed through the fuse from mounting stud 158 to mounting stud 159.

As in the previous embodiments, an integrally molded fuse body 160 has integrally formed annular skirts 162, and an integrally formed end wall 164 at one end thereof. Mounting stud 158 is mounted through an opening in end wall 164 by a threaded nut 165 in the same manner as previously described.

Over the open end of fuse body 160 is positioned a metallic end cap 170 which comprises an end wall portion 174 and an annular flange 176 formed along the edge of wall 174. A lip 178 is integrally molded on the end of fuse body 160 and annular flange 176 is folded over lip 178 to securely attach metallic end cap 170 to the end of fuse body 160. Flange 176 can be folded over lip 178 by any conventional means such as by rolling or magnetic pulse forming. An O-ring seal 171 is positioned in a recess 172 in the end of fuse body 160 to provide a seal to assure that moisture will not be admitted into the interior of fuse body 160. Fuse body 160 may be filled with an electrically non-conducting material 165.

The fuse constructions illustrated in FIGS. 1, 2, 3, and 4 provide substantial advantages over prior art constructions. First, the fuse body may be integrally molded of an epoxy resin or polyester resin and fiber reinforcement may be utilized if additional strength is required. Such a molding process is both convenient and inexpensive and permits fabrication of a fuse body that is inherently strong, inexpensive, and easy to manufacture. Further, by using an integrally molded fuse body, the insulator skirts may be simultaneously molded to the exterior of the fuse body to provide increased surface leakage distance along the exterior of the fuse body thereby avoiding possible flash-over along the surface during and after fuse operation as well as providing additional strength to the fuse body. Accordingly, a much shorter fuse body may be utilized for a fuse having a given voltage rating. The various end closures disclosed herein are both convenient to manufacture and easy to assemble. Such end closures could be used on both ends of the fuse, but it is desirable in some instances to provide a fuse body having one end with an integrally formed end wall to even further simplify assembly. Moreover, the various means of attaching the mounting stud to the integrally formed end wall also facilitate assembly.

It should be expressly understood that various changes, alterations, or modifications may be made in the structure of the various embodiments illustrated herein without departing from the spirit and scope of the present invention as defined in the appended claims.

I claim:

1. In a high voltage fuse including a current responsive fusible element, and first and second conductive terminals respectively electrically connected to opposite ends of the fusible element; an improvement comprising:

a molded hollow fuse body surrounding the fusible element, said fuse body having exterior surface elongating means integrally molded thereto;

end sealing means for closing at least one open end of said fuse body comprising:

a molded end cap formed of rigid resin material having the first conductive terminal mounted therethrough, and rigidly supported thereby said end cap having a rigid end wall portion for closing the at least one open end and a flange portion at the edge of the end wall portion, said flange dimensioned to mate with the end of said fuse body so that said flange can be attached to said fuse body by adhesive.

2. An improvement, as claimed in claim 1, wherein said fuse body has an integrally molded end wall at an other end thereof through which the second conductive terminal is mounted.

3. An improvement, as claimed in claim 2, wherein the second conductive terminal is molded into and through said integrally molded end wall.

4. An improvement, as claimed in claim 2, wherein an opening is provided in said integrally molded end wall through which the second conductive terminal is mounted.

5. An improvement, as claimed in claim 1, wherein said fuse body is fabricated from a material selected from the group consisting of epoxy resin and polyester resin.

6. An improvement, as claimed in claim 5, wherein said material is fiber reinforced.

7. In a high voltage fuse including a current responsive fusible element, and first and second conductive terminals respectively electrically connected to opposite ends of the fusible element; an improvement comprising:

a molded hollow fuse body surrounding the fusible element, said fuse body having exterior surface elongating means integrally molded thereto;

end sealing means for closing at least one open end of said fuse body comprising:

a metal end plate having a peripheral edge positioned over the at least one open end of said body, said end plate having the first conductive terminal mounted thereon;

a threaded flange adapted to threadably engage threads at the end of said fuse body, said flange member overlying only the peripheral edge of said end plate to securely hold said end plate over the at least one open end of said fuse body.

8. An improvement, as claimed in claim 7, wherein said fuse body has an integrally molded end wall at another end thereof through which the second conductive terminal is mounted.

9. An improvement, as claimed in claim 8, wherein the second conductive terminal is molded into and through said integrally molded end wall.

10. An improvement, as claimed in claim 8, wherein an opening is provided in said integrally molded end wall through which the second conductive terminal is mounted.

11. An improvement, as claimed in claim 7, wherein said fuse body is fabricated from a material selected from the group consisting of epoxy resin and polyester resin.

12. An improvement, as claimed in claim 11, wherein said material is fiber reinforced.

13. In a high voltage fuse including a current responsive fusible element, and first and second conductive terminals respectively electrically connected to opposite ends of the fusible element; an improvement comprising:

a molded hollow fuse body surrounding the fusible element, said fuse body having an expanded lip formed around at least one open end thereof, said fuse body having exterior surface elongating means integrally molded thereto;

end sealing means for closing the at least one open end of said fuse body comprising:

a metal end cap, said end cap having an end wall portion dimensioned to overlie the at least one open end of said fuse body, the first conductive terminal being mounted on said end wall portion, and an annular flange integrally formed to the edge of said end wall portion, said annular flange being folded over said lip of said fuse body to lock said metal end cap over the at least one open end.

14. An improvement, as claimed in claim 13, wherein said fuse body has an integrally molded end wall at another end thereof through which the second conductive terminal is mounted.

15. An improvement, as claimed in claim 14, wherein the second conductive terminal is molded into and through said integrally molded end wall.

16. An improvement, as claimed in claim 14, wherein the second conductive terminal is a stud inserted through an opening in said integrally molded end wall and attached by a threaded nut.

17. An improvement, as claimed in claim 13, wherein said fuse body is fabricated from a material selected from the group consisting of epoxy resin and polyester resin.

18. An improvement, as claimed in claim 13, wherein said material is fiber reinforced.

19. In a high voltage fuse including a current responsive fusible element; an improvement comprising:

a molded hollow fuse body surrounding the fusible element, said fuse body having an expanded lip formed around at least one open end thereof, said fuse body having exterior surface elongating means integrally molded thereto;

end sealing means for closing at least one open end of said fuse body comprising:

a metal end cap, said end cap having an end wall portion dimensioned to overlie the at least one open end of said fuse body, said end cap electrically connected to one end of the fusible element to provide electrical continuity thereto, and an annular flange integrally formed to the edge of said end wall portion, said annular flange being folded over said lip of said fuse body to lock said metal end cap over the at least one open end.

20. An improved fuse of the type having a fusible element within a housing, wherein the improvement comprises:

(a) the housing being molded resin in an open-ended configuration;

(b) exterior surface elongating means molded integrally with the housing for increasing the surface leakage distance of the housing;

(c) end cap means for closing an open end of the housing;

(d) means for permitting electrical connection from an end of the fusible element to the exterior of the housing in the vicinity of the end cap means;

(e) flange means formed on the end cap means and matable with the housing at the open end thereof; and (f) means for attaching the flange means to the housing.

21. The fuse of claim 20 wherein the end cap means and the flange means are rigid, molded resin; and the electrical connection means comprises a terminal extending through and rigidly supported by the end cap means, the terminal being connected to the fusible element end.

22. The fuse of claim 20 wherein the end cap means and the electrical connection permitting means comprise a metal disk connected to the fusible element end.

23. The fuse of claim 22 wherein the flange means is a metal flange integral with the metal disk; and the attaching means comprises a lip on the housing adjacent the open end thereof over which the metal flange is folded to lock the disk to the open housing end.

24. The fuse of claim 22 wherein the flange means comprises a threaded member engageable with the periphery of the disk; and the attaching means comprises threads on the housing for engaging in the threaded number to securely hold the disk to the open housing end.

25. An improved fuse of the type having a fusible element within a housing, wherein the improvement comprises:

(a) the housing being molded resin in an open-ended configuration;

(b) exterior surface elongating means molded integrally with the housing for increasing the surface leakage distance of the housing;

(c) end cap means for closing an open end of the housing; and (d) means for permitting electrical connection from an end of the fusible element to the exterior of the housing in the vicinity of the end cap means.

* * * * *

UNITED STATES PATENT AND TRADEMARK OFFICE

CERTIFICATE OF CORRECTION

PATENT NO. : 4,135,174

DATED : January 16, 1979

INVENTOR(S) : Bruce A. Biller

It is certified that error appears in the above-identified patent and that said Letters Patent are hereby corrected as shown below:

In the Abstract

Line 10, "enclosure" should read --closure--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*